US005140782A

United States Patent [19]

Mecteau et al.

[11] Patent Number: 5,140,782

[45] Date of Patent: Aug. 25, 1992

[54] TOOL AND METHOD FOR FORMING A LENS

[76] Inventors: Honore Mecteau, 904-3501 Glen Erin Drive, Mississauga, Ontario, Canada, L5L 2E9; Stewart R. King, 1546 St. James Street, Winnipeg, Manitoba, Canada, R3H 0L2

[21] Appl. No.: 604,515

[22] Filed: Oct. 29, 1990

[51] Int. Cl.[5] ..... B24B 41/00

[52] U.S. Cl. ..... 51/284 R; 51/129; 51/209 R

[58] Field of Search ..... 51/119, 120, 124 R, 51/124 L, 129, 131.1, 209 R, 284 E, 284 R

[56] References Cited

U.S. PATENT DOCUMENTS

| | | | |
|---|---|---|---|
| 908,677 | 1/1909 | Jones | 81/177.85 |
| 1,737,159 | 11/1929 | Johannessen | 51/129 |
| 4,148,160 | 4/1979 | Prunier | 51/209 R |
| 4,165,584 | 8/1979 | Scherrer | 51/131.1 |
| 4,229,911 | 10/1980 | Bicskei | 51/284 E |
| 4,274,232 | 6/1981 | Wylde | 51/406 |
| 4,739,589 | 4/1988 | Brehm et al. | 51/131.1 |

*Primary Examiner*—J. J. Swann

*Attorney, Agent, or Firm*—Adrian D. Battison; Stanley G. Ade; Murray E. Thrift

[57] ABSTRACT

Lens for eye glasses are formed by a method in which a lens is selected having a finished front face and a rear face to be finished to provide a required curvature. The rear face is firstly cut on a Generator machine and is then polished on a cylinder machine. In the invention the conventional metal tool of the cylinder machine is replaced by a tool formed from a plastics material. The tool is mounted on a tool holder by a cooperating shape of the tool holder and a contact surface of the tool including wedge-shaped members and side shoulders which locate the tool without the necessity for a clamping action. The tool is formed by selection of a tool having a curvature approximating to the required curvature following which the approximate tool is cut on the Generator machine to form the required curvature.

5 Claims, 2 Drawing Sheets

TOOL AND METHOD FOR FORMING A LENS

BACKGROUND OF THE INVENTION

This invention relates to a tool for use in forming a lens and to a method of forming a lens and particularly but not exclusively to lenses used in eye glasses.

In a conventional laboratory for manufacturing eye glasses, complex curvature lenses are manufactured for assembly into the eye glasses. In most cases the lens is formed from a lens blank which has a front surface already shaped to a predetermined curvature. A lens of a particular prescription is then formed by cutting and polishing a rear surface of the lens to a calculated curvature related to the selected curvature of the front surface. Lenses such as bifocals and trifocals are usually formed by taking a front surface which has the bifocal or trifocal effect already formed on the front surface so that it is only necessary then to form the rear surface to the required curvatures.

In the conventional process, the lens is grasped by a system comprising applying to the front surface a covering layer of an adhesive film which acts to protect the front surface and at the same time to enable grasping of the front surface without damaging the front surface. Onto the film is cast a boss of a low melting point alloy so that the boss can be readily grasped thus holding the lens with the front surface remaining facing the boss and protected by the boss and the covering film and exposing the rear surface for the cutting action In the first step of the cutting action, the lens is rough cut using a tool known as a Generator which is a milling tool in the form of a cutting ring, the axis of which is twisted to form the required radius of curvature and which then sweeps across the rear surface to provide the cutting action. This acts to reduce the lens to the required thickness and rough cuts the require curvatures which may differ in horizontal direction and vertical direction. These two curvatures are then formed by cutting in the two separate directions so that the lens is held stationary while the tool rotates and sweeps across the rear surface in the cutting action. The Generator is a machine well known to one skilled in the art. One example is manufactured by Optical Works Machinery of Muskogee, Okla. and has been available for many years so that the full details constitute well known prior art.

The rough cut lens in then moved to a polishing and finishing process in which a tool is applied to the rear surface and moved in a figure of eight polishing action relative to the rear surface to smooth the rear surface to the required level of finish. The tool thus has a surface very accurately contoured to the required shape of the finished lens so the polishing action causes the rear surface of the lens to accord to the surface of the tool. A machine of this type is well known to one skilled in the art and is known as a "Cylinder Machine" one example of which is manufactured by Optical Works Machinery of Muskogee, Okla.

Conventionally these machines have tools which are manufactured in a highly complex and expensive process in which the tool is initially rough cast in a suitable metal such as aluminum or steel and then is finished using a time consuming and expensive milling process so that the required level of surface finish is obtained. It will be appreciated that the finish required must be very highly accurate and very highly polished since this is the finish that would be applied to the lens when the lens is polished to accord to this surface.

In previous years the lens was applied directly to the contoured surface of the tool and a suitable slurry or liquid applied between the lens and the surface for the polishing or grinding action.

In more recent years a thin layer of a polishing material as an integral thin film is adhesively applied to the surface of the tool with the layer being sufficiently thin to follow the surface of the tool. The tool can then be used with a number of different layers of different roughness to provide an initial grinding action followed by a finer polishing action and finally a very fine finishing action.

As the tool must accord directly to the required shape of the rear surface of the lens, it is necessary for a laboratory to carry a very large number of such tools. In view of the complex manufacturing technique for the tools including the initial rough casting followed by the skilled machining necessary, the cost of the inventory of such tools is very high so that only a relatively limited number of laboratories are set up for manufacture of the eye glasses.

In recent years however there has been a move toward the manufacture of eye glasses on a retail site so that the customer can be supplied with eye glasses within a very short period of time for example one hour. However the cost of the necessary tools and the inventory of the tools is very high and seriously detracts from the economics of the on-site manufacturing process. Up till now the manufacture of the tool from a rough cast metal followed by the skilled machining process has been considered to be essential in view of the requirement for the very accurate exact contour of the tool surface and in view of the requirement for vigorous clamping action of the tool to ensure that it is held fixed while the relative movement between the lens and the tool is carried out.

SUMMARY OF THE INVENTION

It is one object of the present invention, therefore, to provide an improved tool for use in the finishing action of the lens which is less expensive and simpler to manufacture and thus significantly reduces the cost of the inventory of the tools for an eyeglass manufacturing laboratory.

It is further object of the present invention to provide an improved method of forming a lens which provides improved economics to enable lenses to be manufactured at smaller locations or to be manufactured more cheaply.

According to a first aspect of the invention there is provided therefore a method of forming a lens having one surface requiring a finishing process comprising grasping the lens so as to expose said one surface, selecting from a plurality of tools a tool having a face shaped with an exact contour according to a required finished shape of said one surface, applying on said face of said tool a layer for carrying out a polishing action on said one surface, placing said one surface of the lens on said layer and causing relative movement between the tool and the lens in a polishing action to shape said one surface of the lens, the tool having a tool body on which said face is defined, said tool body including the face thereof being formed from a cast plastics material.

According to a second aspect of the invention there is provided a method of forming a lens for use in eye glasses comprising taking a lens having a finished front surface and a rough cut rear surface, attaching a mounting boss to the front surface such that the rear surface is exposed, selecting from a plurality of tools a tool having a face shaped with an exact contour according to a required finished shape of the rear surface, applying on said face of said tool a layer for carrying out a polishing action on said rear surface, placing said rear surface of the lens on said layer, said tool being mounted upon a tool holder, moving the tool holder in a plane generally parallel to the rear surface, applying a force on the mounting boss to pres the lens onto the tool, moving the mounting boss in a plane generally parallel to the lens so as to cause relative movement between the face of the tool and the lens in a polishing action to shape the rear surface of the lens, the tool having a tool body on which said face is defined, the tool holder having a support surface and the tool body having a contact surface for engaging the support surface of the tool holder, the contact surface being generally opposed to said face such that the force applied to the tool by the lens from the boss in said polishing action passes through said face to the body and through the contact surface to the tool holder, the support surface and the contact surface having a cooperating shape and being held against relative movement therebetween solely by the cooperating shape and the force applied thereto by the polishing action.

According to a third aspect of the invention there is provided a tool for use in polishing a lens comprising a tool body on which a tool face is defined, the tool face having an exact contour shape to polish a surface of the lens to a required surface shape, said tool body and said tool face being formed from a cast plastics material.

The tool can in one embodiment be manufactured by direct casting from a plastics material so that the surface and its exact contour are formed by the direct casting process without the necessity of any separate machining. The present inventor has found that surprisingly the use of the plastic material allows the surface to be directly cast and yet have sufficiently accurate finish. Furthermore the use of the plastics material surprisingly is acceptable without the tool wearing and thus requiring regular replacement. Furthermore the present inventor has found a technique for locating the tool on the tool holder which does not require the strength of metal to enable the tool to be held in place during the side-to-side movement necessary for the polishing action. This location technique uses cooperating wedging surfaces of the tool and tool holder and avoids a conventional clamping action which would damage the plastics material In an alternative technique, the plastics material can be rough cast to an approximate curvature and subsequently cut to shape on the conventional Generator machine already available for cutting the lenses.

The use of the tool according to the invention thus significantly improves the economics of the lens manufacturing process. In addition the tool is significantly lighter which reduces the vibration effect on the polishing machine thus leading to a reduced tendency for the machine to break down due to the vigorous wear of parts.

With the foregoing in view, and other advantages as will become apparent to those skilled in the art to which this invention relates as this specification proceeds, the invention is herein described by reference to the accompanying drawings forming a part hereof, which includes a description of the best mode known to the application and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
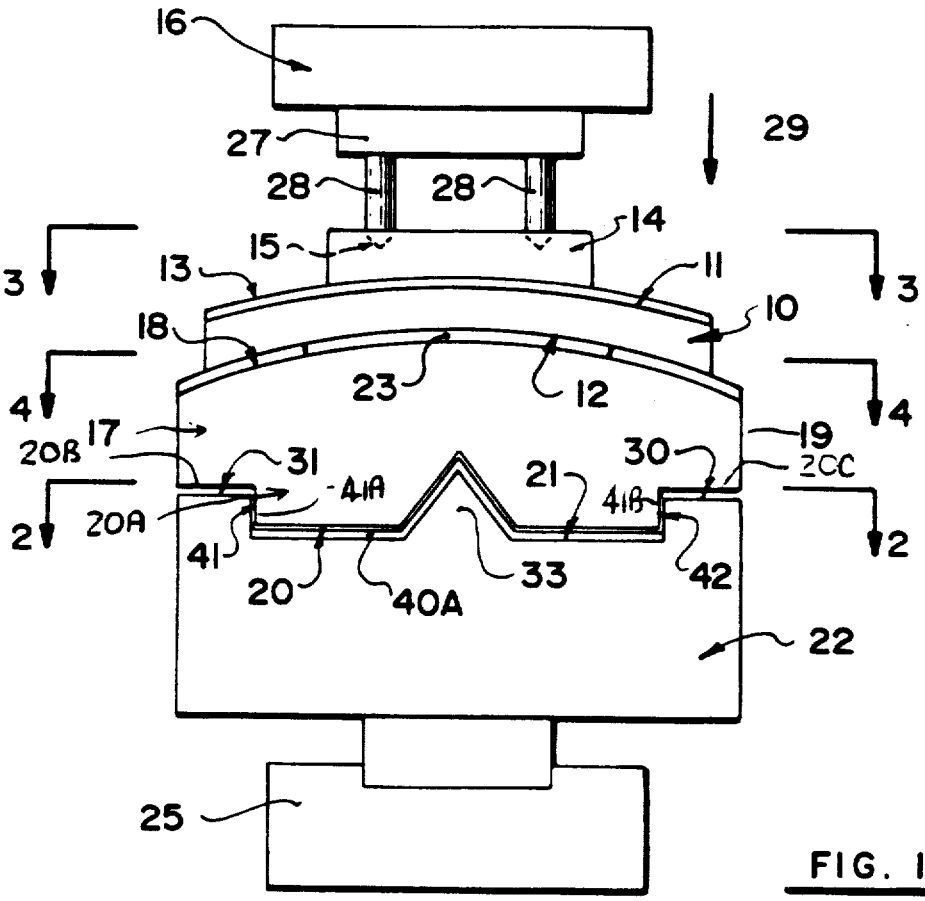
FIG. 1 is a schematic side elevational view of an apparatus for finishing a lens including a tool according to the present invention.

An apparatus for polishing a lens is shown in the drawings and in particular the lens itself is indicated at 10 with the lens having a front surface 11 which is generally finished in a separate process prior to production of the lens by the finishing laboratory. The rear surface of the lens indicated at 12 is the surface which requires finishing so that the prescription of the lens is then finished as required by the calculation of the curvatures 11 and 12.

In a first step of the process, a layer 13 is applied to the front surface so as to cover the front surface to act as a protection therefore and to allow the attachment to the front surface of a cast boss 14. The cast boss is located so that it is properly positioned relative to the center of curvature of the front surface of the lens. The cast boss has a pair of indentations 15 for cooperation with a polishing head 16.

The rear surface 12 of the lens remains uncovered and is therefore available for polishing by the tool indicated at 17. The tool has an upper face 18 which is the face which acts in the polishing action against the rear face of the lens. The contour of the face 18 is chosen with the necessary curvatures in the vertical and horizontal directions to accord to the required prescription. The tool is thus selected from a plurality or inventory of the tools which have been preformed with the various different prescriptions.

The tool is basically a substantially discshaped body having a cylindrical peripheral wall 19, the upper surface 18 and also a contact surface 20 which is substantially on the opposite side of the tool from the working surface 18. The contact surface 20 is shaped to rest upon a support surface 21 of a tool holder 22.

Figure 4:
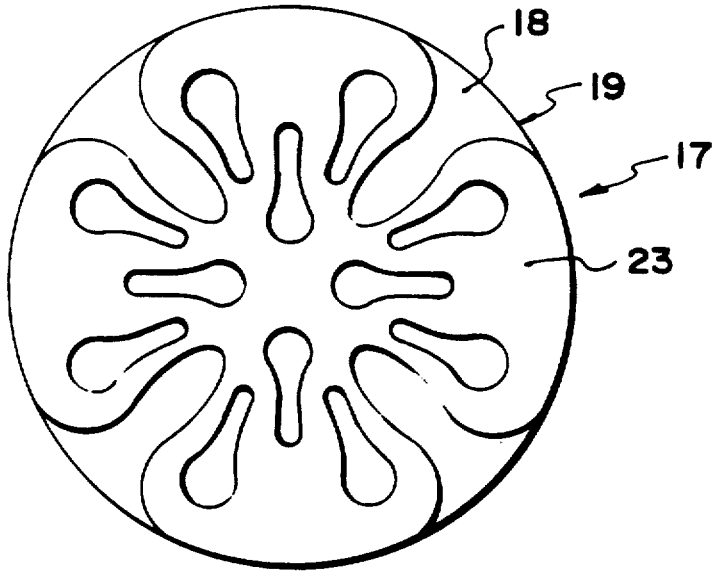
FIG. 4 is a view along the lines 4—4 of FIG. 1 showing the operating face of the tool and the layer applied thereto.

Between the working face 18 of the tool and rear surface 12 of the lens 10 is provided a layer 23 shown best in FIG. 4. The layer is adhesively attached to the working face 18 and provides an upper surface which is sufficiently rough to provide a grinding, polishing or finishing action as required upon the rear surface of the lens. In operation a slurry which may be clear water is provided to ensure proper flow of the particles away from the grinding action. When grinding glass, it is necessary to provide a grinding compound. Plastic lenses can often accommodate water as the lubricating agent.

The layer 23 is shaped in a cloverleaf pattern with a plurality of openings cut into the material so as to leave spaces at which the surface 18 is exposed. These spaces allow the transportation of the lubricating liquid and the removal of the ground particles.

Figure 3:
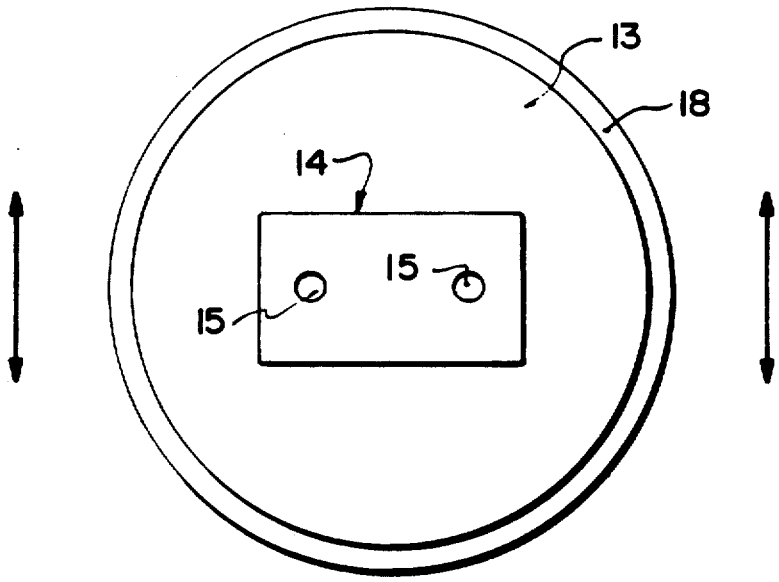
FIG. 3 is a view along the lines 3—3 of FIG. 1 showing the front surface of the lens and the boss attached thereto.

The head 16 is shown only schematically and in addition a drive mechanism 25 for the tool holder 22 is also shown only schematically. These devices including the necessary mounting arrangements and drive arrangements to obtain the motions set out herein are well known to one skilled in the art and can be found for example from "Cylinder Machines" manufactured and sold by Optical Works Machinery. In operation the drive mechanism 25 causes the center of the tool to undergo a figure of eight motion as indicated at 26 which is dimensioned sufficiently to cause the grinding or polishing action. The head 16 carries a drive element 27 including a pair of pins 28 which engage into the recesses 15 of the cast boss 14. These pins include pointed ends so as to allow pivotal movement of the boss and therefore the lens about an axis joining the lower ends of the pins 28. At the same time the head 16 can move vertically to accommodate the vertical movement of the lens which occurs during the polishing action. However the head 16 is designed to apply a vertical load indicated schematically at 29 to press the lens into contact with the working face 18. In addition the head 16 is arranged to move forwardly and backwardly as indicated in FIG. 3 to add to the figure of eight movement generated by the drive mechanism 25 to complete a vigorous polishing action sufficient to act upon all parts of the lens substantially evenly.

In one example, the tool 17 of the present invention is manufactured by direct casting so that the tool itself and also the exact contour of the working face 18 is cast in a single process into a mold carefully formed to provide the required contour and finish of the surface 18.

Various plastics materials can be selected for the casting of the body 17. Preferably the plastics material selected has the following characteristics.

(1) It has sufficient hardness that it is not deformed by the pressure of the lens against the layer 23.

(2) It can be cast at a relatively low temperature and when cast follows exactly the contour of the mold.

(3) Examples of suitable plastics materials are Lexan (TM) manufactured by General Electric, Polyester manufactured by PPG and Polycarbo manufactured by PPG.

In a second technique of manufacture of the tool, the tool is cast to an approximate curvature from the above plastics material. In order to limit the number of molds necessary, the required curvature of the tool face is not directly molded or cast but is instead formed by a cutting action from a tool face of the approximate curvature. Thus a limited number of cast curvatures can be formed and in a tool selected from a limited number and then in separate action cut to the required curvature for the tool face.

The cutting action can be carried out in a conventional Generator machine used for rough cutting of the lenses. In place of the conventional cutting wheel, the cutting can be carried out using a carbide or diamond knife. Such an arrangement is a known device which is known to provide a more accurate cut but is limited in its cutting action and accordingly is not conventionally used for the cutting of lenses. The conventional Generator machine can be used for forming a convex cut by a minor adjustment to the machine without necessity for major modification. As discussed above the cut normally provided by the generator is a concave cut in the rear face of a lens. The conventional machine available in all laboratories can however be adjusted to form a convex cut and can be adjusted to accommodate the carbide or diamond knife which provides the more accurate cutting action.

When directly cut by the Generator machine using the carbide or diamond knife, the curvature of the face is sufficiently accurate to enable use of the face directly on the tool for the polishing action without necessity for further milling or polishing of the tool face.

Figure 2:
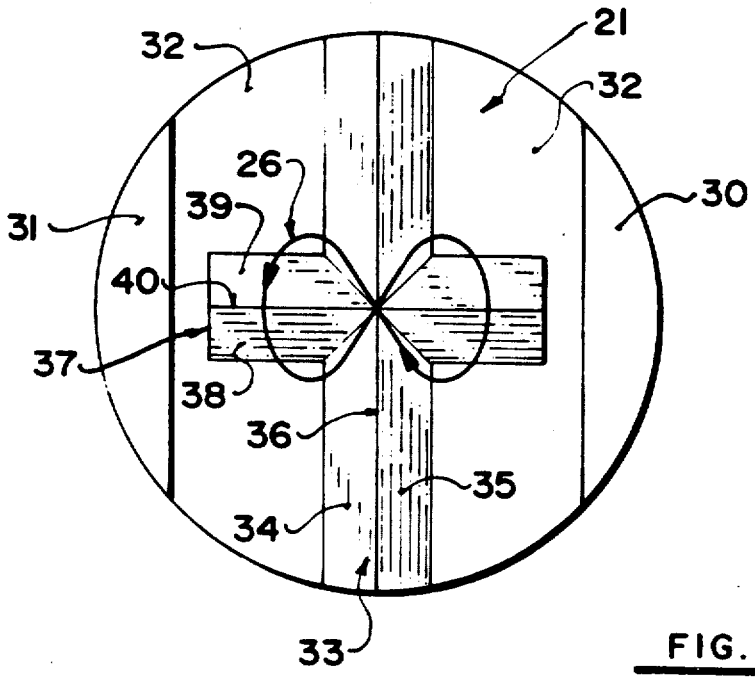
FIG. 2 is a view along the lines 2—2 with the tool removed showing the upper surface of the tool head.

In order to support the tool on the holder 22 without the necessity for a clamping action against the tool, the contact surface of the tool and the support surface of the holder are cooperatingly shaped to prevent transverse movement of the tool relative to the holder. Thus as best shown in FIGS. 1 and 2, the upper surface of the tool holder includes a pair of shoulders 30 and 31 along two opposed sides of the upper surface defining therebetween a recessed section generally indicated at 32. On the recessed section is provided wedge members 33 and 34 extending mutually at right angles on the recessed section 32. The wedge section 33 comprises a pair of inclined walls 34 and 35 extending from a base at the recessed surface 32 up toward an apex 36 spaced upwardly from the surface 32. The apex 36 extends diametrically across the full width of the surface 32. Similarly the wedge section 37 comprises a pair of inclined surfaces 38 and 39 together with an apex 40 extending across the width of the recessed surface 32 and terminating just inside the shoulders 30 and 31. A thin resilient layer 41 is applied onto the recessed surface 32 and onto each of the surfaces 34, 35, 38 and 39. The contact surface 20 of the underside of the tool is exactly cooperatingly shaped so as to receive all of the portions of the surface 21. The contact surface thus includes a central raised portion 20A between two recesses 20B and 20C. On the sides of the raised portion are formed two side surfaces 41A and 41B which extend generally at right angles to the plane of the lens. The inclined surfaces 34 and 35 thus provide a wedging action into the correspondingly shaped recess on the contact surface 20 of the tool and the layer 41 allows a resilient action which provides a frictional effect to hold the tool in place. The wedge members 33 and 37 thus prevent movement in side-to-side or front-to-back directions of the tool on the tool head.

The present inventor has found surprisingly that this simple frictional engagement between the tool and the tool holder in conjunction with the force 29 provided by the member 16 is sufficient to hold the tool in place without the necessity for any grasping or clamping elements which would otherwise damage the plastics material and limit the life of the tool.

In order for the tool to be grasped for the cutting action in the Generator machine described above, the shoulders or side surfaces of the raised portion of the contacting face of the tool indicated at 41A and 41B can be grasped by a clamping tool provided specifically for the Generator machine. One example of clamping tool thus includes a boss similar to the boss 14 for grasping by the generator. The the clamping tool includes a pair of clamping grippers for engaging the opposing side surfaces 40A and 41A on the contacting surface of the tool. Although the tool is formed from a plastics material, the tool need only be grasped once for use in the generator machine and hence the single grasping action necessary by the clamping device of the generator does not cause ongoing damage or wear to the tool. The details of the mounting and cutting action of the "Generator" will be well known to one skilled in the art and can be found from such a machine manufactured by Optical Works Machinery.

In an alternative device, a boss similar to the boss 14 may be directly formed on the contacting surface of the tool for direct grasping by the head of the Generator machine. In yet further arrangement, a special tool is provided for the Generator machine which includes a vacuum grasping system having a surface shape directly corporating with the contacting surface of the tool together with a vacuum suction system for drawing the tool onto the vacuum head.

The tool is preferably cast from Lexan (TM) which is re-enforced by suitable fibrous material to provide the required sheer strength for the tool Since various modifications can be made in my invention as hereinabove described, and many apparently widely different embodiments of sam made within the spirit and scope of the claims without departing from such spirit and scope, it is intended that all matter contained in the accompanying specification shall be interpreted as illustrative only and not in a limiting sense.

We claim:

1. A method of forming a lens for use in eye glasses comprising taking a lens having a finished front surface and a rough cut rear surface, attaching a mounting boss to the front surface such that the rear surface is exposed, selecting from a plurality of tools a tool having a face shaped with an exact contour according to a required finished shape of the rear surface, placing said rear surface of the lens on said face, said tool being mounted upon a tool holder, moving the tool holder in a plane generally parallel to the rear surface, applying a force on the mounting boss to press the lens onto the tool, moving the mounting boss in said plane generally parallel to the rear surface so as to cause relative movement between the face of the tool and the lens in a polishing action to shape the rear surface of the lens, the tool having a tool body on which said face is defined, said tool being formed of a plastics material with the face thereof defined by the plastics material, the tool holder having a support surface and the tool body having contact surface for engaging the support surface of the tool holder, the contact surface being generally opposed to said face such that the force applied to the tool by the lens from the boss in said polishing action passes through said face to the body and through the contact surface to the tool holder, the support surface and the contact surface having a cooperating shape and being held against relative movement therebetween solely by the cooperating shape and the force applied thereto by the polishing action, said support surface of the tool holder having a pair of spaced, raised shoulders defining a recess therebetween, the contact surface of the tool being correspondingly shaped to define a raised portion between two recesses with sides of the raised portion forming surfaces extending in a direction generally perpendicular to said plane parallel to said rear surface, one of said recess of the support surface and said raised portion of said contact surface including a first pair of surfaces inclined to said plane and converging to a first elongate apex raised from the respective surface and including a second pair of surfaces inclined to said plane and converging to a second elongate apex raised from the respective surface with the first and second apexes arranged parallel to said plane and at an angle to each other, the other of said recess and said raised portion including a first pair of surfaces inclined to said plane and converging to a first elongate apex recessed from the respective surface and a second pair of surfaces inclined to said plane and converging to a second elongate apex recessed from the respective surface, the first surfaces of said one being arranged to cooperate with the first surfaces of the other in a wedging action and the second surfaces of said one being arranged to cooperate with the second surfaces of the other in a wedging action.

2. The method according to claim 1, wherein said contact surface and support surface are shaped such that said first and second elongate apexes are arranged mutually at right angles.

3. The method according to claim 2 wherein said contact surface and support surface are shaped such that said first elongate apex is arranged parallel to said raised shoulders and centrally between said raised shoulders.

4. The method according to claim 3 wherein said contact surface and support surface are shaped such that the recess between said first and second pairs of surfaces and said raised shoulders, consist of a substantially planar surface parallel to said plane.

5. The method according to claim 1 including providing the tool by the step of:

(a) selecting from a number of tools having differing surface contours a tool having a contour approximating to said exact contour of the required finished shape, each of the tools being formed of a plastics material; and (b) mounting the tool in a Generator machine and operating the Generator machine to cut a convex curvature on said tool exactly equal to said exact contour.

* * * * *